United States Patent [19]

Prewett et al.

[11] Patent Number: 4,516,052

[45] Date of Patent: May 7, 1985

[54] DISPENSER FOR ION SOURCE

[75] Inventors: Phillip D. Prewett, Abingdon; Derek K. Jefferies, Didcot; Neil A. Pashley, Sutton Courtenay; Thomas D. Cockhill, Newbury, all of England

[73] Assignee: Dublier Scientific Limited, Oxfordshire, England

[21] Appl. No.: 384,321

[22] Filed: Jun. 1, 1982

[30] Foreign Application Priority Data

Jun. 2, 1981 [GB] United Kingdom ..... 8116841

[51] Int. Cl.[3] ..... H01J 17/26; B65D 47/10

[52] U.S. Cl. ..... 313/546; 222/541

[58] Field of Search ..... 313/546, 163, 232, 328, 313/362.1, 550; 222/541; 250/423 P, 425; 206/532

[56] References Cited

U.S. PATENT DOCUMENTS

| | | | |
|---|---|---|---|
| 2,754,442 | 7/1956 | Boutry et al. | 313/230 X |
| 4,085,330 | 4/1978 | Wolfe | 250/492.2 |
| 4,262,160 | 4/1981 | McKoon et al. | 373/11 |
| 4,318,029 | 3/1982 | Jergenson | 313/362.1 |

*Primary Examiner*—Palmer Demeo
*Assistant Examiner*—Sandra L. O'Shea
*Attorney, Agent, or Firm*—Wenderoth, Lind & Ponack

[57] ABSTRACT

A dispenser for supplying metal vapor to an ion source. The metal is provided in a capsule which may be broken to release the metal by turning a knob which causes a capsule housing to move to the right, thus causing the capsule to break against a piston member. The piston member communicates with a conduit which in turn communicates with the associated ion source, partly shown in the drawing. A heating mantle is provided to vaporize the metal in the housing so that it can pass from the dispenser through a conduit, to the ion source.

9 Claims, 4 Drawing Figures

DISPENSER FOR ION SOURCE

BACKGROUND OF THE INVENTION

This invention relates to a dispenser for an ion source.

Ion sources are used in industry for material processing and surface analysis. The ion beam produced by these sources may be generated in various ways. The type of ion source with which the present invention is concerned is one in which a film of liquid metal on the surface of a needle electrode is subjected to an electric field which produces a source of ions which latter can then be extracted from the liquid metal by electric field emission. In such ions sources the liquid metal to be ionised is stored in a temporary reservoir surrounding the rear end of the needle, and flows to the tip of the needle, where the ionisation takes place, by surface tension. The metal in the reservoir is heated to a temperature sufficient to keep the metal in the liquid state but not too great as to cause the metal to vapourise. Obviously, the exact temperature depends on the characteristics of the particular metal being used.

OBJECT AND SUMMARY OF THE INVENTION

These ion sources can be used to ionize a wide range of metals, the particular metal being chosen in accordance with the requirements of use, and the intention of this invention is to provide a dispenser for supplying to the reservoir in the ion source the metal to be ionised. In one aspect, the invention provides a dispenser for ion sources comprising a container for metal to be dispensed, heating means for heating the metal within said container in order to vapourise it and conduit means for providing a fluid connection between said container and the reservoir in an associated ion source. The dispenser is operated by heating the metal in the container so that the metal evaporates, and allowing the vapour so produced to diffuse through the conduit means to the reservoir where it condenses. In order to avoid premature condensation of the vapour in the conduit means, there is preferably provided means for heating the vapour as it passes along the conduit.

It will also be seen that, after use, any residual molten metal remaining in the ion source reservoir may be returned to the dispenser for subsequent disposal simply by reversing the above process—i.e. heating the molten metal in the reservoir, and allowing the resultant vapour to condense in the container within the dispenser. In this way, highly reactive materials, or materials with other undesirable properties, can be disposed of safely and easily without the risk of danger to the operator or to the ion source itself.

As already mentioned, the particular metal used for ionisation is determined by the particular requirements of the ion source. Gallium, for example, is a frequently used source of ions. However, it happens that some of the metals which it is desired to use possess undesirable properties. In particular, the metal caesium has a heavy ion which is very desirable in a number of applications but difficulty is experienced in utilising caesium in view of its highly reactive nature when in contact with the atmosphere. Generally speaking, ion sources are used in vacuum, often a high vacuum so the problem with caesium manifests itself, not during normal operation of the source, but in getting the caesium into the source—i.e. into the reservoir of the source—in the first place. In order to meet this problem, an embodiment of the invention provides that the metal to be ionised is contained in a small capsule which may be broken to release the metal. In this case the container for metal to be dispensed has means whereby it may be opened to introduce a capsule, together with means for breaking the capsule within the container in order to release the metal.

The use of a capsule ensures not only that the metal can be kept isolated during transference to the ion source, but also provides a particularly convenient way of presenting the metal to be ionised in preset doses to the ion source. It is anticipated therefore that the use of a capsule will find favour not only with difficult-to-use metals such as caesium but also as a convenient transport medium for other metals used in ion sources.

BRIEF DESCRIPTION OF THE DRAWINGS

In order that the invention may be better understood, an embodiment thereof will now be described by way of example only and with reference to the accompanying drawings in which.

DETAILED DESCRIPTION OF THE PREFERRED EMBODIMENT

Figure 1:
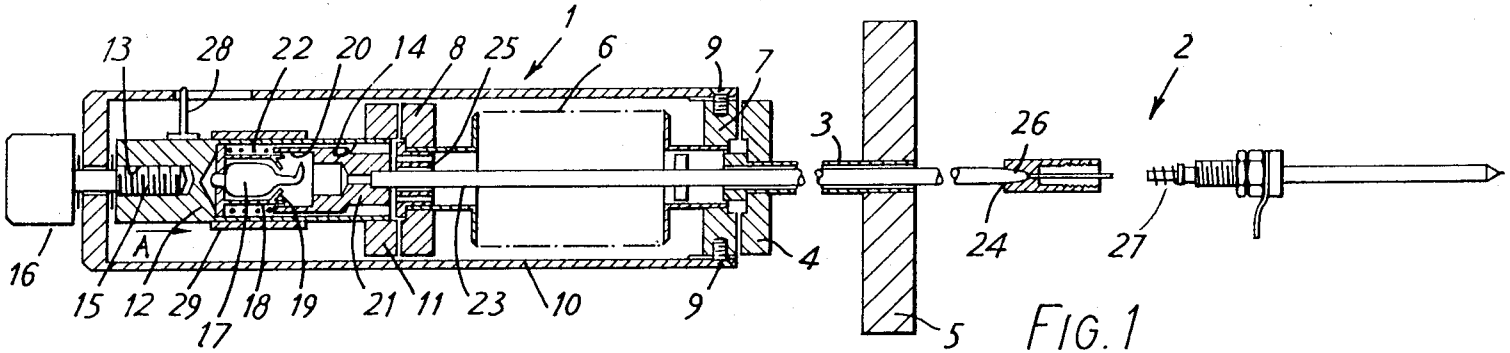
FIG. 1 is a sectional side view of one embodiment of a dispenser according to the invention, showing also part of the associated ion source.

Referring particularly to FIG. 1, the dispenser is shown under reference 1 operably attached to an associated ion source which, for simplicity, is shown in part only under reference 2. The dispenser and its associated source are rigidly mounted with respect to one another by means of a tube 3 which is welded at one end to a flange 4 forming part of the dispenser and at the other end to a flange 5 forming part of the ion source. Electrical connections (not shown) belonging to the ion source are taken through the flange 5, and a space is therefore necessary between the source and the dispenser to clear these.

The dispenser 1 comprises a bellows assembly 6 which is attached at one end to a flange 7 bolted to the flange 4, and at the other end to a flange 8. The flange 7 is attached by screws 9 to a cylindrical housing 10 while the flange 8 is slidably mounted within the housing. Attached to the flange 8 is a further flange 11, also slidably mounted within the housing 10, which latter flange mounts a capsule housing 12.

Figure 2:
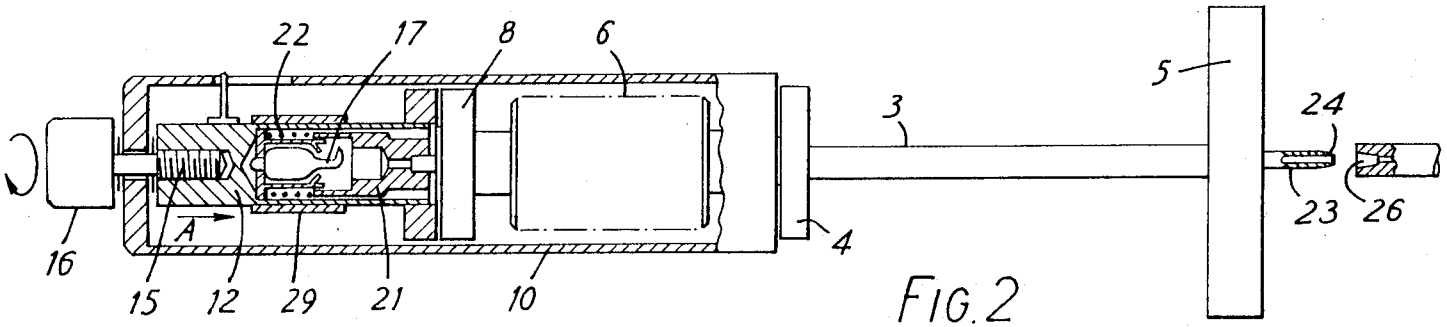
FIGS. 2, 3 and 4 are diagrammatic sectional side views similar to FIG. 1 showing three different stages in the operation of the device.
Figure 3:
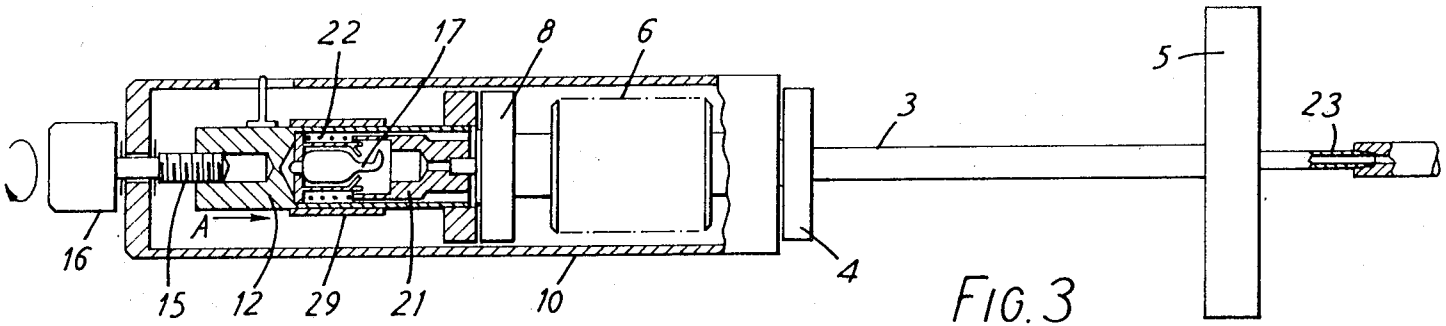

The capsule housing 12 is cylindrical in shape and is formed with axial blind bores 13, 14 extending from either end. That on the left-hand end (when seen in FIG. 1) is the smaller and is threaded to receive the threaded shank 15 of a bolt, the head 16 of which lies outside the housing 12 and takes the form of a knob suitable for manual rotation. The shank is rotatably mounted with a clearance fit through a hole in the housing 10 and is equipped with collars (see FIGS. 2 to 4) which prevent axial movement of the shank relative to the housing 10. Thus, when the knob 16 is rotated, the capsule housing 12 is moved axially with respect to the housing. A pointer 28 mounted on the capsule housing 12 and visible through a slot cut in the housing 10 indicates the relative position of the two housings to the operator.

The bore 14 at the right-hand end of the capsule housing 12 defines a chamber for a glass capsule 17 filled with metal to be dispensed. The capsule is mounted within this chamber in a holder 18 and is retained within the holder by means of bent-over tags 19. The holder is itself mounted within an axial bore 20 formed in a piston member 21 which is slidably mounted within the bore 14 of the capsule housing 12. A coil spring 22 also mounted within the bore 14 acts to bias the piston member 21 in a rightwards direction with respect to the housing 12. As is clear from the drawings, the bore 20 in the piston member is stepped inwardly to a relatively narrow bore which corresponds with that of a feed tube 23 which is attached to the piston member 21 for axial movement therewith. The feed tube 23 extends right through the bellows assembly 6 and the tube 3 in coaxial relation therewith and terminates at point 24 on the ion source side of the flange 5. A copper spider 25 centres the tube 23 with respect to the left hand end of the bellows assembly 6, and also provides a connection for electrical current flow to the tube 23, as will be explained below. The end 24 of the feed tube is shown seated in a correspondingly shaped receptacle 26 which is part of the ion source. The receptacle 26 is in fluid communication with the ion source reservoir 27 which latter forms a temporary reservoir for molten metal about to be ionised. The manner in which this is carried out is known, and will not be explained further.

The dispenser is assembled for use by first fitting the capsule 17 containing metal for example caesium, to be ionised into its holder 18 and bending the tabs 19 inwards to retain it. The spring 22 is fitted over the holder and the assembly is thence fitted into the bore 20 of the piston member 21, taking care not to depress the spring and break the glass prematurely. The capsule housing 12 is now carefully placed over the piston and capsule holder and is bolted to the left hand end of the bellows assembly 6 by way of flanges 11 and 8, a copper gasket seal being sandwiched between them. The housing 10, to which is attached the knob 16, is now fitted over the assembly until the end of the shank 15 enters the threaded bore 13. At this point the knob 16 is rotated to draw the assembly within the housing 1 until the screws 9 may be fitted. The knob 16 is now turned until the pointer 28 is at the left-hand end of the slot in housing 1, and the feed tube 23 is inserted into the tube 3 and the flanges 4 and 7 bolted together, again with a copper gasket inbetween. The dispenser is now ready for use, and is in the position shown in FIG. 2, with the end 24 of the feed tube 23 spaced from the receptacle 26.

In order to dispense a charge of metal from the capsule into the reservoir 27 within the ion source, the assembly, including the ion source to the right of the flange 5, and the interior of the tube 3, bellows assembly 6 and the bore 14 of the capsule housing 12 to the left of the piston member 21, are evacuated, and the reservoir is heated by means of a heater (not shown) to a temperature sufficient to varpourise any condensate within the reservoir to thus ensure that the reservoir presents a clean surface. For caesium, this temperature is about 900° C. At the same time, the capsule housing is heated by means of a heating mantle 29 surrounding the capsule housing 12 to a temperature of about 150° C. Once any outgassing is judged complete, the reservoir is allowed to cool and the knob 16 is turned to cause the capsule housing 12 to move relative to housing 10 in the direction of arrow A. The capsule housing 12 carries with it the feed tube 23 which likewise moves to the right towards the receptacle 26. Eventually, the end of the tube 23 enters the receptacle 26, forming a fluid-tight joint therewith. At this point, shown in FIG. 3, further rightwards movement of tube 23 is prevented with the result that further rightwards movement of the capsule housing 12 causes the piston member 21 to move relative to the capsule housing 12 against the bias of spring 22. Also at this point the entry of the end of tube 23 into the receptacle makes an electrical connection with enables current-about 6A—to be passed through the tube 23 via spider 25 to heat the tube and prevent subsequent condensing of vapour within it.

Figure 4:
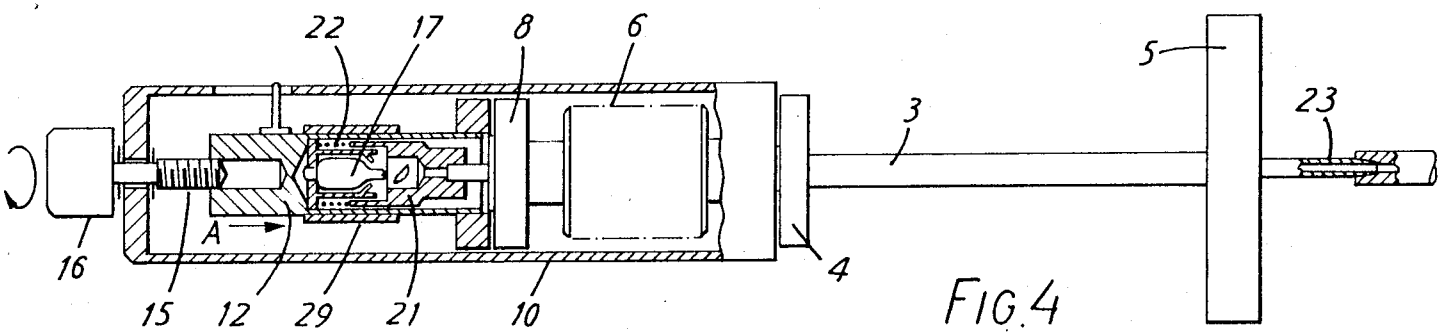

When the reservoir temperature is down to 40° C., the knob 5 can be screwed further until some resistance is felt and the neck of the glass capsule 17 broken, as shown in FIG. 4, due to the action of the stepped bore 20 of the piston member 21.

The heat is now turned off and the device allowed to cool. During this time metal vapour released when the capsule was broken passes along tube 23 to the reservoir in the ion source where it condenses. Before operating the ion source, the knob 16 is unscrewed to retract the end 24 of the feed tube 23 from the receptacle 26 which latter, during operation of the ion source, is at high voltage. When the operator of the ion source is complete, any unused metal in the reservoir 27 can be safely returned to the dispenser for disposal by reconnecting the end 24 of tube 23 with the receptacle 26 and heating the reservoir 27 to vapourise any remaining metal and drive it back into the relatively cooler dispenser where it condenses. The metal can then be allowed to disperse naturally without fear of damaging the delicate ion source.

We claim:

1. A dispenser for ion sources, comprising:

a capsule containing a metal to be ionized, said capsule being breakable to release the metal;

a container for containing said capsule, said container having means for opening said container to introduce the capsule into said container and means for breaking the capsule within said container in order to release the metal;

heating means for heating the metal within said container in order to vaporize the metal; and conduit means for providing a fluid connection between said container and a reservoir in an associated source into which the metal is to be dispensed.

2. A dispenser as claimed in claim 1, further comprising conduit heating means for heating fluid passing along said conduit means.

3. A dispenser as claimed in claim 1, wherein said means for breaking said capsule comprises a shoulder, said shoulder being movable relative to said capsule to break said capsule and release the metal.

4. A dispenser as claimed in claim 3, wherein said container comprises two hollow cylindrical members one of which is slidably movable within the other, a first of which is closed at one end and the second of which communicates with said conduit means, said two members defining a substantially closed space for containing said capsule therein, said container further comprising means for breaking said capsule in response to relative movement between said two members.

5. A dispenser as claimed in claim 4, further comprising: a housing enclosing said container, said conduit means protruding from said housing, said first and second members, together with said conduit means, being movable with respect to said housing in the direction of sliding movement of the one of said two members;

spring means for biasing said two members apart in said direction; said dispenser further comprising means for rigidly fixing said housing to the associated ion source, and means for moving said conduit means, and said second member therewith, into fluid communication with the reservoir of the associated ion source and then moving said first and second members together against the bias of said spring means so as to break said capsule in respective response to movement of said first member in said direction until said conduit means is in fluid communication with the reservoir of the associated ion source and continued movement of said first member in said direction thereafter.

6. A dispenser as claimed in claim 2, wherein said means for breaking said capsule comprises a shoulder, said shoulder being movable relative to said capsule to break said capsule and release the metal.

7. A dispenser as claimed in claim 6, wherein said container comprises two hollow cylindrical members one of which is slidably movable within the other, a first of which is closed at one end and the second of which communicates with said conduit means, said two members defining a substantially closed space for containing said capsule therein, said container further comprising means for breaking said capsule in response to relative movement between said two members.

8. A dispenser as claimed in claim 7, further comprising: a housing enclosing said container, said conduit means protruding from said housing, said first and second members, together with said conduit means, being movable with respect to said housing in the direction of sliding movement of the one of said two members; spring means for biasing said two members apart in said direction; said dispenser further comprising means for rigidly fixing said housing to the associated ion source, and means for moving said conduit means, and said second member therewith, into fluid communication with the reservoir of the associated ion source and then moving said first and second members together against the bias of said spring means so as to break said capsule in respective response to movement of said first member in said direction until said conduit means is in fluid communication with the reservoir of the associated ion source and continued movement of said first member in said direction thereafter.

9. A dispenser for ion sources, comprising:

a container for containing a breakable capsule holding a metal to be ionized, said container having means for opening said container to introduce the capsule into said container and means for breaking the capsule within said container in order to release the metal held therein;

heating means for heating the metal within said container in order to vaporize the metal; and conduit means for providing a fluid connection between said container and a reservoir in an associated ion source into which the metal is to be dispensed.

* * * * *

UNITED STATES PATENT AND TRADEMARK OFFICE

CERTIFICATE OF CORRECTION

PATENT NO. : 4,516,052

DATED : May 7, 1985

INVENTOR(S) : Thomas D. Cockhill, Neil A. Pashley, Phillip D. Prewett and Derek K. Jefferies It is certified that error appears in the above-identified patent and that said Letters Patent is hereby corrected as shown below:

In the cover page of the patent, in the upper left hand corner, directly below "United States Patent", change "Prewett et al" to --Cockhill et al--.

In the cover page of the patent, in item [75], the space provided for the names of the inventors, delete in its entirety and insert the following:

--Inventors: Cockhill, Thomas D., Newbury; Pashley, Neil A., Sutton Courtenay; Prewett, Phillip D., Abingdon; Jefferies, Derek K., Didcot, all of England--.

Signed and Sealed this

*Seventeenth* Day of *September 1985*

[SEAL]

*Attest:*

*Attesting Officer*

DONALD J. QUIGG

*Commissioner of Patents and Trademarks—Designate*